US008653388B2

(12) United States Patent
Nishikimi et al.

(10) Patent No.: US 8,653,388 B2
(45) Date of Patent: Feb. 18, 2014

(54) SWITCH DEVICES FOR POWER TOOLS

(75) Inventors: Junichi Nishikimi, Anjo (JP); Masahiro Maegawa, Anjo (JP); Akira Tomonaga, Anjo (JP)

(73) Assignee: Makita Corporation, Anjo-shi (JP)

( * ) Notice: Subject to any disclaimer, the term of this patent is extended or adjusted under 35 U.S.C. 154(b) by 225 days.

(21) Appl. No.: 12/869,099

(22) Filed: Aug. 26, 2010

(65) Prior Publication Data

US 2011/0056813 A1 Mar. 10, 2011

(30) Foreign Application Priority Data

Sep. 4, 2009 (JP) ..... 2009-204458

(51) Int. Cl.
*H01H 19/06* (2006.01)

(52) U.S. Cl.
USPC ..... 200/302.3

(58) Field of Classification Search
USPC ..... 200/302.1–302.3; 439/271, 272, 277
See application file for complete search history.

(56) References Cited

U.S. PATENT DOCUMENTS 5,506,378 A * 4/1996 Goldenberg ..... 200/302.1
5,552,570 A * 9/1996 Shinohara et al. ..... 200/302.1
5,879,178 A * 3/1999 Koumatsu et al. ..... 439/271
5,911,588 A * 6/1999 Kern ..... 439/278
7,034,234 B1 * 4/2006 Brillhart ..... 200/302.3
7,525,792 B2 * 4/2009 Yokote ..... 200/302.1
2006/0270262 A1 * 11/2006 Schmidt et al. ..... 439/271

FOREIGN PATENT DOCUMENTS

DE 1 926 967 A1 11/1970
FR 2 657 996 A3 8/1991
JP A-4-368727 12/1992
JP A-9-17280 1/1997
JP A-9-320398 12/1997
JP A-2001-110271 4/2001

OTHER PUBLICATIONS

Extended Search Report issued in European Application No. 10174607.1 dated Dec. 27, 2010.

* cited by examiner

*Primary Examiner* — Felix O Figueroa
(74) *Attorney, Agent, or Firm* — Oliff PLC

(57) ABSTRACT

A switch device for a power tool includes a switch case and a switch lever. The switch lever extends outwardly from within the switch case. The switch lever has a rotative portion rotatably supported by a support portion of the switch case. A waterproofing member is disposed between the rotative portion and the support portion and provides a waterproof seal therebetween.

4 Claims, 7 Drawing Sheets

SWITCH DEVICES FOR POWER TOOLS

This application claims priority to Japanese patent application serial number 2009-204458, the contents of which are incorporated herein by reference.

BACKGROUND OF THE INVENTION

1. Field of the Invention

The present invention relates to switch devices for power tools, such as hand-held power screwdrivers.

2. Description of the Related Art

A known power screwdriver has a tool body having an electric motor disposed therein. A handle protrudes laterally from the tool body. A trigger-type switch lever is mounted to a base portion of the handle. A user can operate the switch lever with his or her fingers to push a switch knob of a switch body assembled within the handle, so that the electric motor is started. Then, a driver bit mounted to a spindle at a position on the side of the front end of the tool body rotates in a driving direction. In order to enable a screw loosening operation in addition to a screw fastening operation, the electric motor can rotate in a reverse direction to rotate the spindle in a screw loosening direction.

An on/off switching circuit and a normal/reverse switching circuit for the motor are disposed within the switch body that is assembled within the handle. Shifting the trigger-type switch lever in forward and rearward directions can operate the switch knob that protrudes laterally from the switch body, so that the on/off switching circuit can be operated. A normal/reverse switching lever can be rotated in forward and rearward directions to operate an electric contact device disposed at the upper portion of the switch body, so that the normal/reverse switching circuit can be operated. In general, the normal/reverse switching lever is rotatably supported on the upper portion of the switch body and assembled with the switch body.

In order to improve the waterproof performance and the dustproof performance of the switch body, various techniques are proposed in Japanese Laid-Open Patent Publications Nos. 4-368727, 9-17280, 9-320398 and 2001-410271.

Although the techniques proposed in the above publications may provide waterproof structures for the switch body, they do not provide sufficient waterproof structures at a position where the normal/reverse switching lever is mounted. Thus, according to the proposed techniques, waterproof or dustproof performance of the switch case are achieved by configuring the switch case to have case halves that are joined to each other by welding or adhesion. Therefore, the on/off switching circuit can be sealingly contained in the switch case. However, the contact device of the normal/reverse switching circuit operable by the normal/reverse switching lever is exposed outside at the upper portion of the switch body, and therefore, waterproofing of the switch device about the normal/reverse switching lever is still required.

Therefore, there is a need in the art for a switch device that has an improved waterproof performance.

SUMMARY OF THE INVENTION

A switch device for a power tool includes a switch case and a switch lever. The switch lever extends outwardly from within the switch ease. The switch lever has a rotative portion rotatably supported by a support portion of the switch case. A waterproofing member is disposed between the rotative portion and the support portion and provides a waterproof seal therebetween.

DETAILED DESCRIPTION OF THE INVENTION

Figure 1:
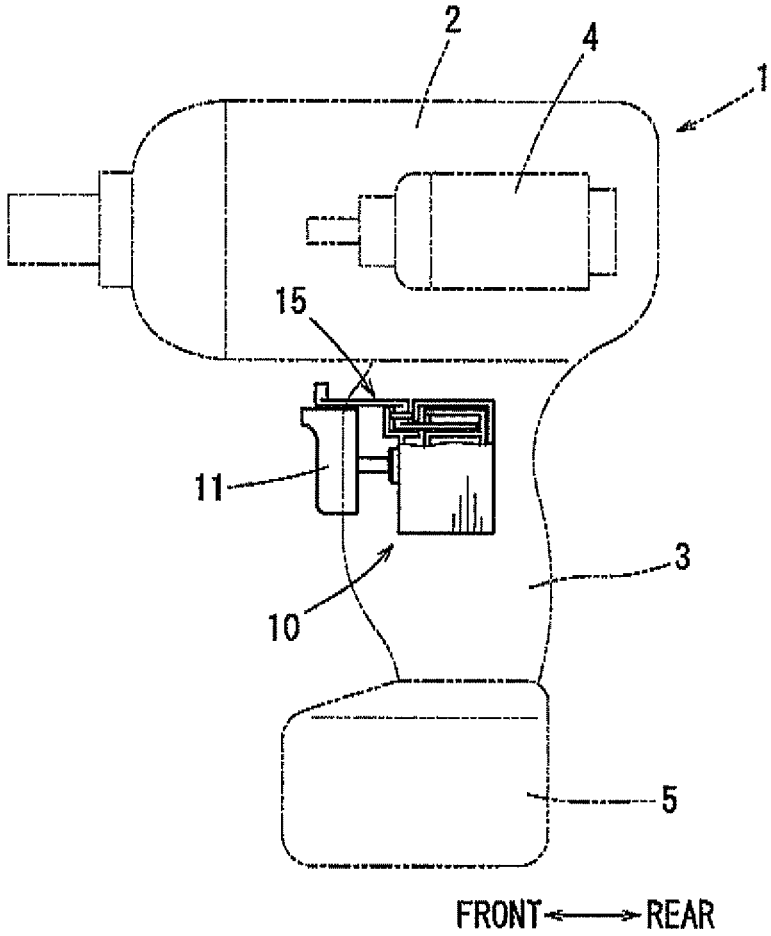
FIG. 1 is a side view of a power tool incorporating a switch device according to a first example, with the switch device being indicated by solid lines and with the outline of the power tool indicated by two-dot chain lines.

Each of the additional features and teachings disclosed above and below may be utilized separately or in conjunction with other features and teachings to provide improved switch devices and power tools incorporating such switch devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

In one example, a switch device for a power tool includes a switch case and a switch lever. The switch lever includes an operation portion operable by an operator, an actuation portion inserted into the switch case, and a rotative portion. The operation portion and the actuation portion may be connected to the rotative portion, so that the operation portion, the rotative portion and the actuation portion jointly form a crank shape. The switch case has a support portion rotatably supporting the rotative portion of the switch lever. Therefore, the switch lever can rotate relative to the switch case, so that the switch device can operate to cause different operations of the power tool according to rotation of the switch lever. A seal member is fitted on the rotative portion for waterproofing the inside of the switch ease.

Because a waterproof performance is given by the seal member fitted on the rotative portion of the switch lever, it is possible to improve the waterproof performance a the entire switch device.

In addition, the rotative portion serves as a rotational center of the lever, and therefore, its moving range is limited in comparison with the operation portion. This enables to effectively seal the inside of the switch case by using a smaller seal member. Eventually, the size of the switch device can be minimized.

Due to the waterproofing performance, it is also possible to prevent dust or foreign particles from entering the switch case.

For example, the switch lever may be a normal/reverse switching lever for switching the rotational direction of a motor of the power tool. The switch lever may rotate about a vertical axis (leftward and rightward) or about a horizontal axis (upward and downward).

A recess may be formed in the rotative portion along the entire circumference thereof, and the seal member may be fitted into the recess to form a labyrinth between the seal member and the rotative portion. With this arrangement, the waterproof performance can be further improved.

The recess may include a first recess and a second recess, and the seal member may include a first seal member and a second seal member fitted into the first recess and the second recess, respectively. With this arrangement, a more complicated labyrinth can be provided to further improve the waterproof performance.

In an alternative arrangement, the seal member has opposite end portions fitted into the first recess and the second recess, respectively. Also with this arrangement, it is possible to provide a more complicated labyrinth.

A projection may be formed on the rotative portion along the entire circumference thereof in place of the recess. In this connection, the seal member may include a first seal member and a second seal member fitted on the rotative portion at positions on opposite sides of the projection to form a labyrinth between each of the first and second seal members and the rotative portion. Also with this arrangement, it is possible to provide a complicated labyrinth.

Alternatively, the seal member (a single member) may be fitted on the rotative portion to cover the projection, so that a labyrinth is formed between the seal member and a part of the rotative portion having the projection.

The seal member may have an engaging recess formed in an outer circumferential surface thereof; and the support portion may have an engaging projection capable of engaging the engaging recess, so that a labyrinth is formed between the seal member and the support portion.

In another example, an elastomeric resin layer may be molded integrally with at lease one of the rotative portion and an inner circumferential surface of a support recess of the support portion for waterproofing between the rotative portion and the inner circumferential surface of the support recess.

In a further example, a water absorbing member may be attached to the rotative portion for waterproofing the switch case.

Figure 2:
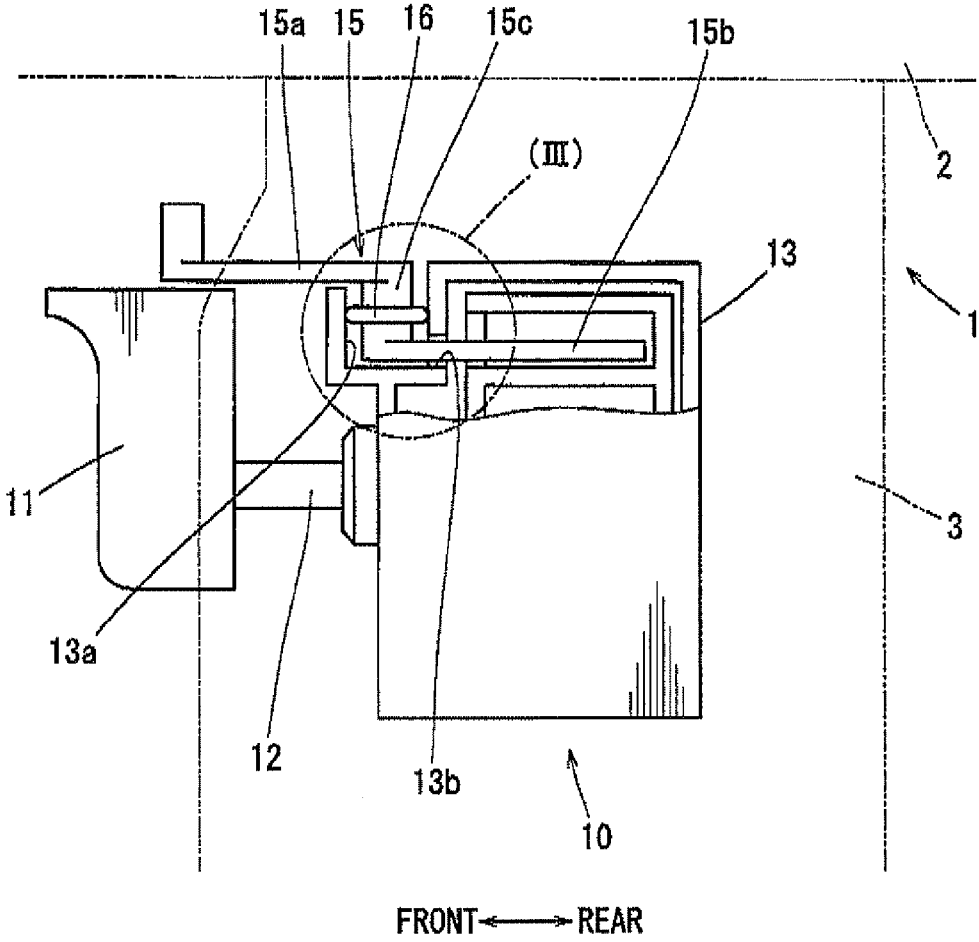
FIG. 2 is a side view of the switch device with an upper portion of a switch case broken away for showing the internal structure of the switch case.
Figure 3:
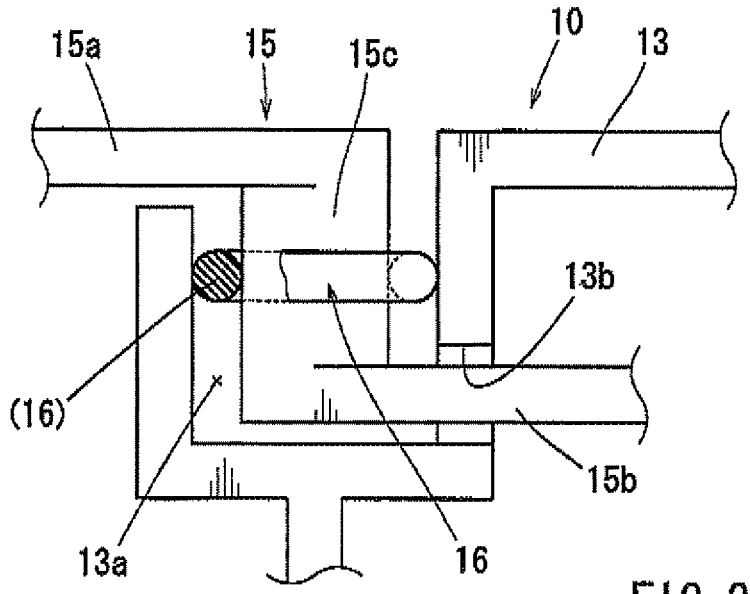
FIG. 3 is an enlarged view of a region surrounded by a circle III in FIG. 2 and showing a rotative portion of a switch lever and its surroundings.

Various examples will now be described with reference to the drawings. Referring to FIGS. 1 to 3, a power tool 1 incorporating a switch device 10 according to a first example is shown. In this example, the power tool 1 is a power screwdriver. The switch device 10 is assembled within a handle 3 of the power tool 1. The handle 3 protrudes laterally from a tool body 2 of the power tool 1 and the switch device 10 is positioned within the base end portion of the handle 3 on the side of the tool body 2. An electric motor 4 and a screw tightening mechanism (not shown) driven by the rotational force of the electric motor 4 are disposed within the tool body 2.

The switch device 10 has a switch lever 11 operable for turning on/off of a power source circuit of the electric motor 4. The switch lever 11 protrudes forwardly from the front surface of the handle 3. When a user grasps the handle 3 and pulls the switch lever 11 with fingers of his or her hand used for grasping the handle 3, the switch device 10 is switched on, so that the power source circuit is turned on to start the motor 4. A rechargeable battery pack is mounted to the lower end of the handle 3 and supplies an electric power to the motor 4.

The switch device 10 is shown in more detail in FIG. 2. The switch device 10 has substantially rectangular box-shaped switch case 13. The switch case 13 is formed by case halves made of resin. In order to form the switch case 13, the case halves are positioned to be opposed to each other and are then joined together by suitable means, such as welding and adhesion. Electric components, such as circuit boards, are received within the switch case 13. A switch rod 12 protrudes forwardly from the front surface of the switch case 13. An on/off switch lever 11 is mounted to the protruded end of the switch rod 12.

A normal/reverse switching lever 15 is disposed at the upper portion of the switch device 10 and can be rotated to change the rotational direction of the motor 4 between a normal direction used for a screw tightening operation and a reverse direction used for a screw loosening operation. More specifically, pivoting the normal/reverse switching lever 15 in right and left directions (directions perpendicular to the sheet of FIG. 2) within a predetermined angular range can change the rotational direction between the normal direction and the reverse direction. The position of the normal/reverse switching lever 15 is chosen such that the user can pivot the switching lever 15 in right and left directions with his or her fingers of a band that grasps the handle 3.

The normal/reverse switching lever 15 has an operational portion 15*a*, an actuation portion 15*b* and a rotative portion 15*c* connecting the operational portion 15*a* and the actuation portion 15*b* to each other. The operational portion 15*a* is rigidly connected to the upper part of the rotative portion 15*c* and protrudes forwardly from within the handle 3. The actuation portion 15*b* is rigidly connected to the lower portion of the rotative portion 15*c* and extends into the switch case 13. The rotative portion 15*c* is configured as a rod having a substantially cylindrical shape. The switch case 13 has an upper front corner portion defining a cylindrical support recess 13*a*, in which the rotative portion 15*c* is rotatably supported. Therefore, the normal/reverse switching lever 15 is supported by the upper front portion of the switch case 13. The operational portion 15*a* extends forwardly from a position above the support recess 13*a*. The actuation portion 15*b* extends from the rotative portion 15*c* into inside of the switch case 13 via an insertion hole 13*b* that is formed in the upper front portion of the switch case 13 in communication with the support recess 13*a*.

In this way, the rotative portion 15*c* having a cylindrical configuration is rotatably supported within the support recess 13*a* that also has a cylindrical configuration, so that the switching lever 15 can pivot in right and left directions within a predetermined angular range. A seal ring 16 serving as a waterproof member is fitted on the rotative portion 15*c*. In this example, an O-ring made of elastomeric material, such as rubber and elastomeric resin, is used as the seal ring 16. Therefore, the normal/reverse switching lever 15 can be pivoted about an axis of the rotative portion 15*c* while the seal ring 16 slidably contacts the inner circumferential surface of the support recess 13*a*. As a result, inside of the support recess 13*a* can be sealed from the outside, so that it is possible to prevent water, dust and foreign particles from entering inside of the switch case 13 via the insertion hole 13*b*.

FIGS. 4 through 11 show various modifications of the first example. In FIGS. 4 through 11, like members are given the same reference signs as the first example and the description of these members will not be repeated.

Figure 4:
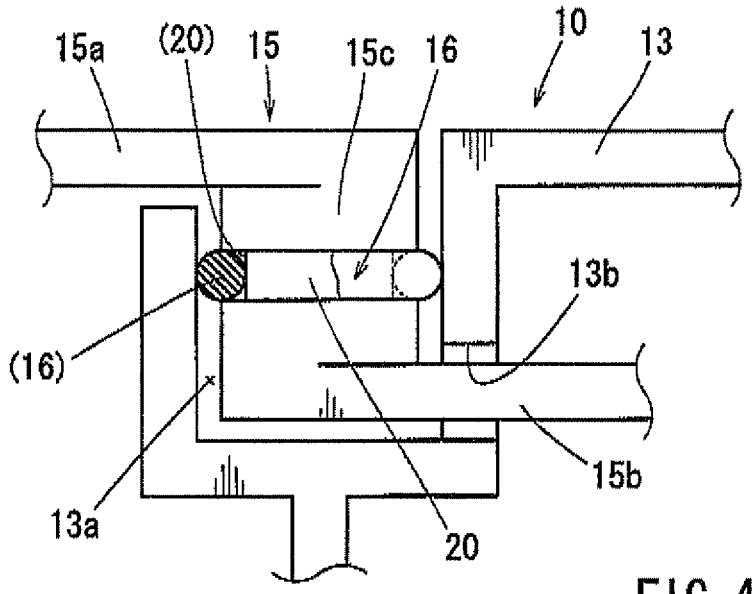
FIGS. 4 to 11 are views similar to FIG. 3 but showing switch devices according to second to ninth examples.

Referring to FIG. 4, a second example is shown that is different from the first example in that the seal ring 16 is fitted into an annular recess 20 formed in the outer circumferential wall of the rotative portion 15*c* and extends along its entire circumference. Thus, the seal ring 16 slidably contacts the inner circumferential surface of the support recess 13*a* while it is supported within the annular recess 20.

In addition, fitting the seal ring 16 into the annular recess 20 provides a labyrinth structure between the seal ring 16 and the rotative portion 15*c*. Therefore, the second example provides a further improved waterproof performance.

Figure 5:
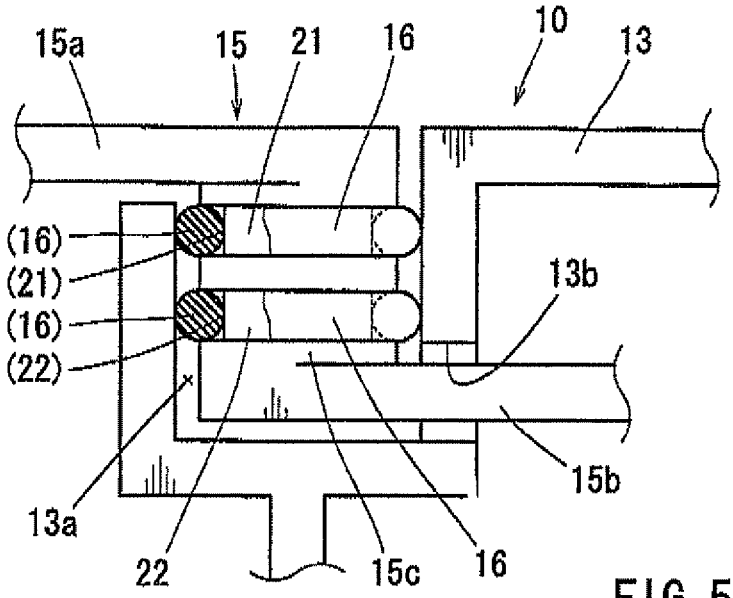

Referring to FIG. 5, a third example is shown that is a further modification of the second example. In this example, two parallel annular recesses 21 and 22 are formed in the outer circumferential surface of the rotative portion 15*c* and spaced from each other in the axial direction of the rotative portion 15*c*. Also, each of the annular recesses 21 and 22 extends along the entire circumference of the rotative portion 15*c*. Two seal rings 16 are fitted into the annular recesses 21 and 22, respectively, and slidably contact the inner circumferential surface of the support recess 13*a*. With this arrangement, fitting the seal rings 16 into the annular recesses 21 and 22 can provide a more complicated labyrinth structure between the seal rings 16 and the rotative portion 15*c* than in the case of the second example. Therefore, the third example provides a further improved waterproof performance.

Figure 6:
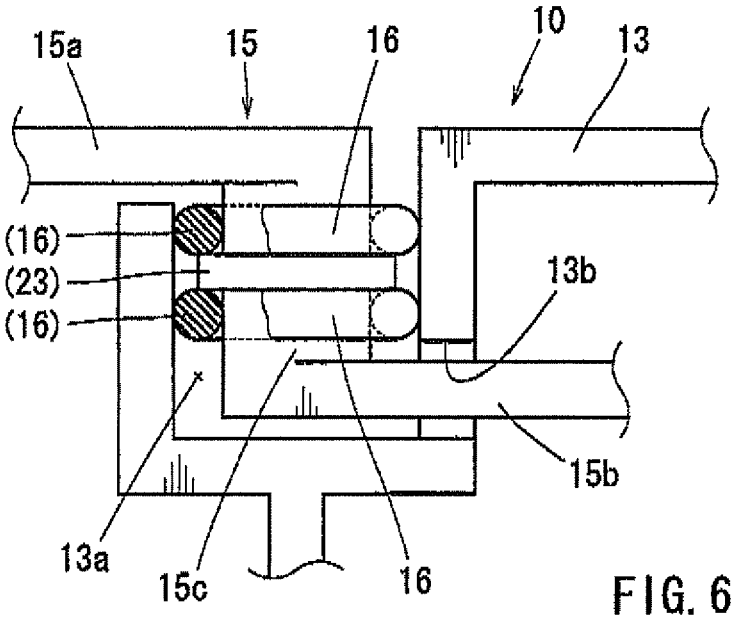

Referring to FIG. 6, a fourth example is shown that is a further modification of the third example. In this example, the annular recesses 21 and 22 are omitted. Instead, a flange-like annular projection 23 is formed on the outer circumferential surface of the rotative portion 15*c* and positioned at a substantially middle position with respect to the axial length of the rotative portion 15*c*. The annular projection 23 has the same axis as the rotative portion 15*c* and has a diameter larger than the remaining portion of the rotative portion 15*c*. The seal rings 16 are fitted on the outer circumferential surface of the rotative portion 15*c* at positions on opposite sides of the annular projection 23. Also with this arrangement, a more complicated labyrinth structure than in the case of the second example can be provided between the seal rings 16 and the rotative portion 15*c*.

In the case of the arrangement of the third example utilizing the recesses 21 and 22 formed in the rotative portion 15*c* and the arrangement of the fourth example utilizing the projection 23, the seal rings 16 may be replaced with a seal ring 17 to further improve the waterproof performance as in fifth and sixth examples that will be hereinafter described.

Figure 7:
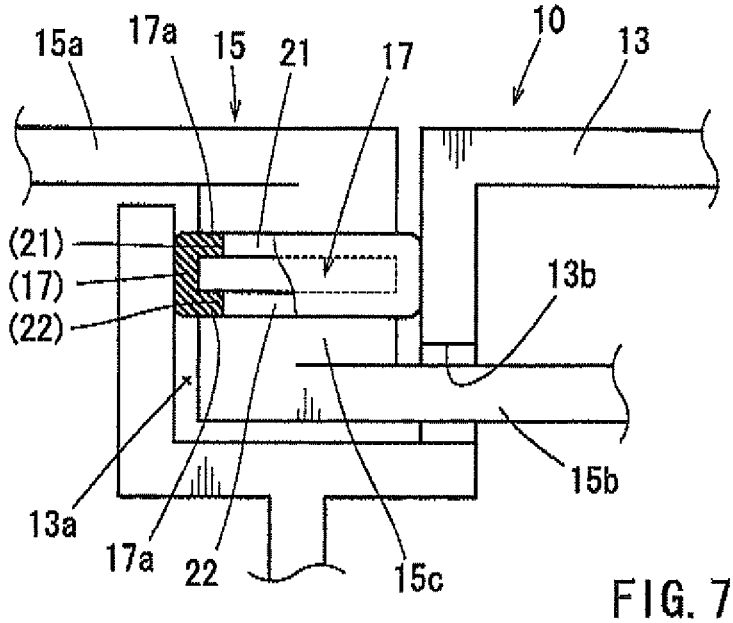

According to the fifth example shown in FIG. 7, two parallel recesses 21 and 22 are formed in the rotative portion 15*c* in the same manner as the third embodiment. The seal ring 17 serving as a waterproof member is a single member and is fitted on the rotative portion 15*c* to extend between the recesses 21 and 22. Also in this example, the seal ring 17 is made of elastomeric material, such as rubber and elastomeric resin. The seal ring 17 has a U-shaped cross section and has a pair of bent portions 17*a* disposed on opposite sides in the widthwise direction of the seal ring 17. Each of the bent portions 17*a* has an L-shaped cross section. The bent portions 17*a* are fitted into the recesses 21 and 22, respectively. The outer circumferential surface of the seal ring 17 slidably contacts the inner circumferential surface of the support recess 150. Also with this arrangement, a labyrinth structure similar to that of the third example can be provided to improve the waterproof performance. In addition, the width of the seal ring 17 is larger than the sum of the diameters of the two seal rings 16, and a contact area of the seal ring 17 with the inner circumferential surface of the support recess 15*c* is larger than that of the two seal rings 16. Therefore, the waterproof performance can be improved also in this respect.

Figure 8:
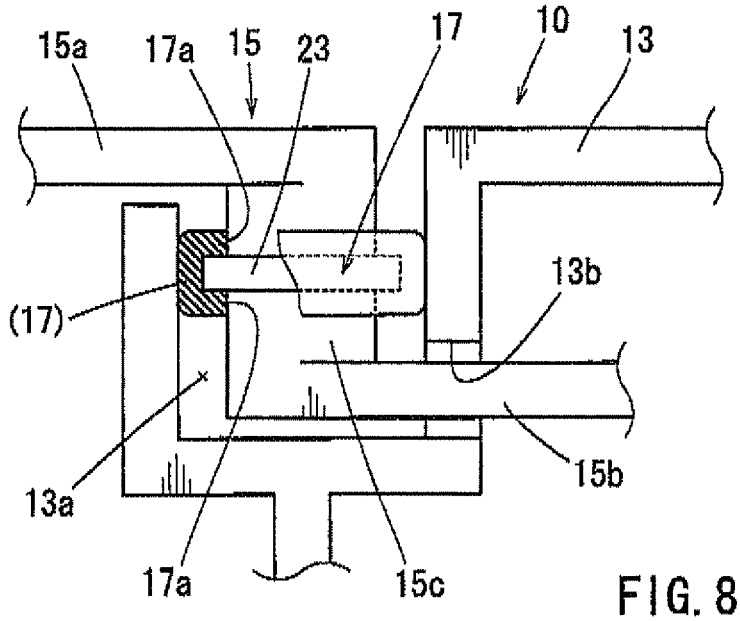

According to the sixth example shown in FIG. 8, the annular projection 23 is formed on the rotative portion 15*c* in the same manner as the fourth example. A seal ring 17 similar to that described in the fifth embodiment is fitted on the rotative portion 15*c* in such a manner that the seal ring 17 covers the annular projection 23. More specifically, the projection 23 is fitted between the L-shaped bent portions 17*a*. The outer circumferential surface of the seal ring 17 slidably contacts the inner circumferential surface of the support recess 13*a*. Also with this arrangement, due to fitting of the L-shaped bent portions 17*a* with the annular projection 23, a labyrinth structure is provided between the seal ring 17 and the rotative portion 15*c* to improve the waterproof performance.

Figure 9:
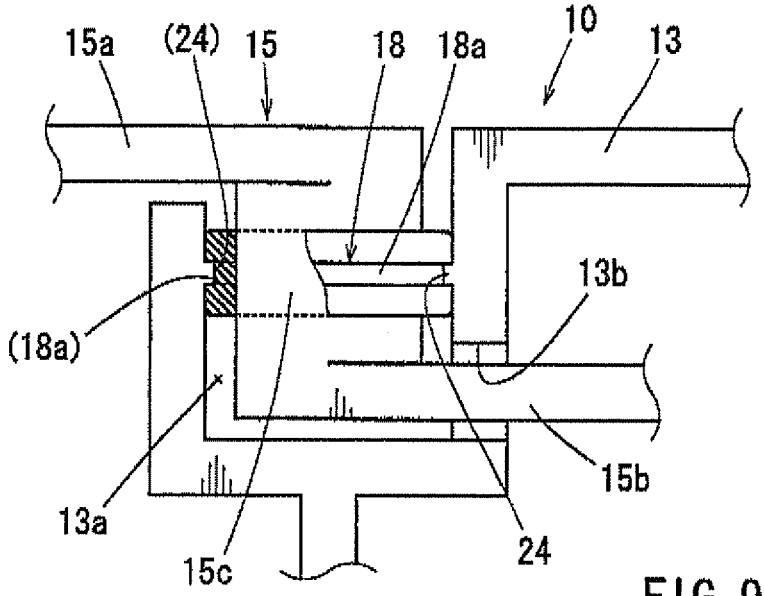

A seventh example is shown in FIG. 9. Also in this example, a seal ring 18 made of elastomeric material is used as a waterproof member. However, the seal ring 18 has an annular recess 18*a* formed in the outer circumferential surface of the seal ring 18 and extending along the entire circumferential length of the same. The seal ring 18 is fitted on the rotative portion 15*c* that has no annular recess 20, 21 or 22 and no annular projection 23. In this example, an annular projection 24 is formed on the inner circumferential surface of the support recess 13*a* of the switch case 13 and extends along the entire circumferential length of the same. The annular projection 24 is fitted into the annular recess 18*a* of the seal ring 18. Therefore, with the annular projection 24 fitted into the annular recess 18*a* of the seal ring 18, the seal ring 18 slidably contacts the inner circumferential surface of the support recess 13*a*. Thus, in this example, a labyrinth structure is provided between the seal ring 18 and the inner circumferential wall of the support recess 13*a*, so that the waterproof performance can be improved.

In this way, a labyrinth structure can be given by providing the annular projection 24 on the side of the support recess 13*a* instead of providing the annular recess 20, the annular recesses 21 and 22 or the annular projection 23 on the side of the rotative portion 15*c*.

The arrangement of the seventh example may be inversed such that a projection is formed on the outer circumferential surface of the seal member 18 and an annular recess is formed in the inner circumferential wall of the support recess 13*a* in order to provide a labyrinth structure between the seal ring 18 and the inner circumferential wall of the support recess 13*a*.

In addition, the labyrinth structure of the seventh example can be applied in combination with any of the labyrinth structures of the second to sixth examples. Thus, labyrinth structures can be provided between a seal ring (waterproof member) and the rotative portion 15*c* and between the seal ring and the inner circumferential surface of the support recess 13*a* by providing an annular recess or an annular projection on each of the rotative portion 15*c* and the inner circumferential surface of the support recess 13*a*, fitting the seal ring into the annular recess or onto the annular projection of the rotative portion 15*c*, and fitting the seal ring also into the annular recess or onto the annular projection of the inner circumferential surface of the support recess 13*a*. This arrangement can further improve the waterproof performance.

Figure 10:
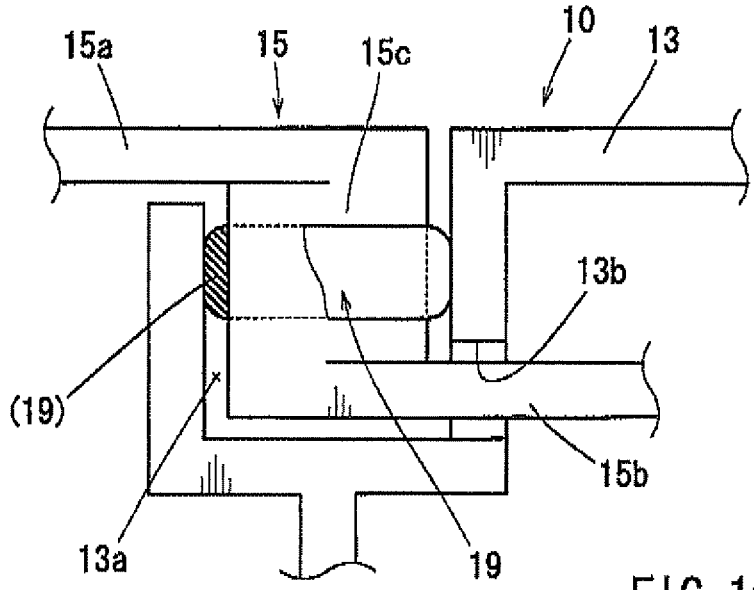

An eighth example will now be described with reference to FIG. 10. In this example, instead of fitting the seal ring (16, 17 or 18) on the rotative portion 15*c*, a seal layer 19 serving as a waterproof member and made of elastomeric resin is molded integrally with the rotative portion 15*c*. The outer circumferential surface of the seal layer 19 slidably contacts the inner circumferential wall of the support recess 13*a*. For example, by using a two-color (two-different resin) molding technique, the seal layer 19 can be molded to cover the surface of the rotative portion 15*c* at the same time that the normal/reverse switching lever 15 is molded. Although not shown in the drawings, in place of or in addition to the seal layer 19, it may be possible to mold a seal layer (made of elastomeric resin similar to the seal layer 19) on the inner circumferential surface of the support recess 13*a*.

By integrally molding the seal layer 19 (or a seal layer similar to the seal layer 19) with the rotative portion 15*c* and/or the inner circumferential surface of the support recess 13*a*, the normal/reverse switching lever 15 and the seal layer (or the switch case 13 and the seal layer) can be handled as a one-piece member. Therefore, it is possible to minimize the number of parts of the switch device 10 and to facilitate the assembling operation.

The eighth example can be further modified. For example, an annular recess (or annular projection) may be formed on the outer surface of the seal layer 19, while an annular projection (or annular recess) may be formed on the inner circumferential surface of the support recess 13*a* for fitting with the annular recess (or annular projection). With this arrangement, a labyrinth structure can be provided between the seal layer 19 and the inner circumferential surface of the support recess 13*a*.

Figure 11:
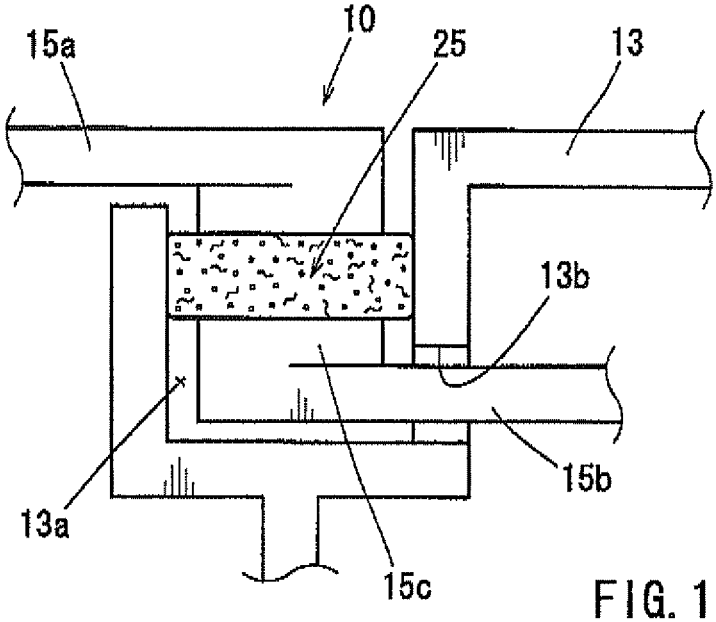

A ninth example is shown in FIG. 11. In this example, instead of the seal ring (16, 17, 18 or 19) made of elastomeric material, a seal ring 26 made of water absorbing material is fitted on the rotative portion 14*c*. For example, the water absorbing material may be a sponge having interconnected foam cells. Also with the seal ring 26 having a water absorbing property, it is possible to prevent water, dust and any other foreign materials from entering the inside of the switch ease 13 via the support recess 13*a*. Therefore, it is also possible to provide a waterproofing function.

Also, the seal ring 26 may have an annular recess or an annular projection similar to those of the seal rings in the previous examples in order to provide a labyrinth structure for further improving the waterproof performance.

As described above, any of the seal rings 16, 17, 18 and 25 of the above examples, which are fitted on the rotative portion 15*c* of the normal/reverse switching lever 15, can prevent or minimize intrusion of water, dust and any other foreign particles into the support recess 13*a* and further into the switch case 13 via the insertion hole 13*b*.

Because the waterproofing performance of the normal/reverse switching lever 15 within the support recess 13*a* is given by the seal ring (waterproof member) fitted on the rotative portion 15*c*, it is possible to improve the waterproof performance of the switch device 10 and to eventually improve the durability of the switch device 10.

Further, the annular recess (20, 21, 22) or the annular projection 23 formed on the rotative portion 15*c* can provide a labyrinth structure at a potential foreign material intrusion path (or a potential water intrusion path) that may be formed between the seal ring (16, 17) and the rotative portion 15*c*. Therefore, the waterproof performance can be further improved.

Further, as in the case of the seventh example, it is also possible to provide a labyrinth structure between the seal ring 18 and the inner circumferential wall of the support recess 13*a* by fitting the projection 24 (formed on the inner circumferential wall of the support recess 13*a*) into the recess 18*a* formed in the seal ring 18.

Although the above examples have been described in connection with the normal/reverse switching lever 15 of the power tool 1 configured as a power screwdriver, the above examples can be applied to any other switch devices used for switching between different operations of the power screwdriver. It is also possible to apply the teachings of the above examples to switching devices of the other power tools, such as a power drill, a hammer drill and a table saw, as long as they are rotated leftward, rightward, upward or downward in order to change the operating condition.

Further, although O-rings made of elastomeric material are used as the seal rings 16, 17 and 18, sponges having independent foam cells can be used in, place of the O-rings.

Furthermore, although a sponge having interconnected foam cells was used as the water absorbing material of the seal ring 25 in the ninth example, the sponge can be replaced with any other water absorbing material, such as felt or the like.

What is claimed is:

1. A switch device for a power tool, comprising:

a switch case;

a switch lever including an operation portion operable by an operator, an actuation portion inserted into the switch case, and a rotative portion; and a seal member fitted on the rotative portion for waterproofing an inside of the switch case, wherein the operation portion and the actuation portion are connected to the rotative portion, so that the operation portion and the actuation portion extend substantially perpendicular to an axial direction of the rotative portion at different positions along the axial direction of the rotative portion, the switch case has a support portion rotatably supporting the rotative portion of the switch lever, a recess is formed in the rotative portion along an entire circumference of the rotative portion, the seal member is fitted into the recess to form a labyrinth between the seal member and the rotative portion, the recess includes a first recess and a second recess, the seal member has opposite end portions fitted into the first recess and the second recess, respectively, the first recess and the second recess are each comprised of a first wall, a second wall, and third wall, and the first wall is parallel to the second wall.

2. A switch device for a power tool, comprising:

a switch case;

a switch lever including an operation portion operable by an operator, an actuation portion inserted into the switch case, and a rotative portion; and a seal member fitted on the rotative portion for waterproofing an inside of the switch case, wherein the operation portion and the actuation portion are connected to the rotative portion, so that the operation portion and the actuation portion extend substantially perpendicular to an axial direction of the rotative portion at different positions along the axial direction of the rotative portion, the switch case has a support portion rotatably supporting the rotative portion of the switch lever, a projection is formed on the rotative portion along an entire circumference of the rotative portion, the seal member includes a first seal member and a second seal member fitted on the rotative portion at positions on opposite sides of the projection to form a labyrinth between each of the first and second seal members and the rotative portion, and the projection has an outer diameter larger than an outer diameter of a remaining portion of the rotative portion where the projection is not formed.

3. A switch device for a power tool, comprising:

a switch case;

a switch lever including an operation portion operable by an operator, an actuation portion inserted into the switch case, and a rotative portion; and a seal member fitted on the rotative portion for waterproofing an inside of the switch case, wherein the operation portion and the actuation portion are connected to the rotative portion, so that the operation portion and the actuation portion extend substantially perpendicular to an axial direction of the rotative portion at different positions along the axial direction of the rotative portion, the switch case has a support portion rotatably supporting the rotative portion of the switch lever, a projection is formed on the rotative portion along an entire circumference of the rotative portion, the seal member is fitted on the rotative portion to cover the projection, so that a labyrinth is formed between the seal member and a part of the rotative portion having the projection, and the projection has an outer diameter larger than an outer diameter of a remaining portion of the rotative portion where the projection is not formed.

4. A switch device for a power tool, comprising:

a switch case;

a switch lever including an operation portion operable by an operator, an actuation portion inserted into the switch case, and a rotative portion; and a seal member fitted on the rotative portion for waterproofing an inside of the switch case, wherein the operation portion and the actuation portion are connected to the rotative portion, so that the operation portion and the actuation portion extend substantially perpendicular to an axial direction of the rotative portion at different positions along the axial direction of the rotative portion, the switch case has a support portion rotatably supporting the rotative portion of the switch lever, the seal member has an engaging recess formed in an outer circumferential surface of the seal member, the support portion has an engaging projection capable of engaging the engaging recess, so that a labyrinth is formed between the seal member and the support portion, and the engaging recess extends in a circumferential direction of the seal member along an entire circumference of the outer circumferential surface of the seal member.

* * * * *